US010683781B2

(12) United States Patent
Kunz et al.

(10) Patent No.: US 10,683,781 B2
(45) Date of Patent: Jun. 16, 2020

(54) ADJUSTABLE CAMSHAFT HAVING A PHASE ACTUATOR

(71) Applicants: THYSSENKRUPP PRESTA TECCENTER AG, Eschen (LI); thyssenkrupp AG, Essen (DE)

(72) Inventors: Michael Kunz, Chemnitz (DE); Bernd Mann, Zschopau (DE); Uwe Dietel, Lichtentanne (DE); Martin Lehmann, Mittelndorf (DE)

(73) Assignees: THYSSENKRUPP PRESTA TECCENTER AG, Eschen (LI); THYSSENKRUPP AG, Essen (DE)

( * ) Notice: Subject to any disclaimer, the term of this patent is extended or adjusted under 35 U.S.C. 154(b) by 1 day.

(21) Appl. No.: 15/752,328

(22) PCT Filed: Jul. 29, 2016

(86) PCT No.: PCT/EP2016/068160
§ 371 (c)(1),
(2) Date: Feb. 13, 2018

(87) PCT Pub. No.: WO2017/025356
PCT Pub. Date: Feb. 16, 2017

(65) Prior Publication Data

US 2018/0238200 A1 Aug. 23, 2018

(30) Foreign Application Priority Data

Aug. 13, 2015 (DE) ..... 10 2015 113 356

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 1/34413* (2013.01);
(Continued)

(58) Field of Classification Search
CPC ..... F01L 1/3442; F01L 1/34413; F01L 1/047; F01L 2001/0476; F01L 2001/0473; F01L 2001/34423
See application file for complete search history.

(56) References Cited

U.S. PATENT DOCUMENTS 7,228,831 B1 * 6/2007 O'Gorman ..... F01L 1/047 123/90.15
7,270,096 B2 9/2007 Lancefield
(Continued)

FOREIGN PATENT DOCUMENTS

CN 102678217 A 9/2012
CN 103987927 A 8/2014
(Continued)

OTHER PUBLICATIONS

English Translation of International Search Report issued in PCT/EP2016/068160, dated Oct. 25, 2016 (mailed Nov. 2, 2016).

*Primary Examiner* — Patrick Hamo
*Assistant Examiner* — Wesley G Harris
(74) *Attorney, Agent, or Firm* — thyssenkrupp North America, LLC

(57) ABSTRACT

An adjustable camshaft for a valve train of an internal combustion engine may include an inner shaft that is rotatable in an outer shaft, a phase shifter by which the outer shaft and/or the inner shaft are/is adjustable in a phase position formed around an axis of rotation, and a bearing portion for bearing the camshaft, via which the phase shifter can be supplied with a pressurizing medium. The inner shaft may comprise an end on which a screw flange is arranged, and a rotor of the phase shifter may be connected to the screw flange. A free end of the inner shaft comprises a duct that coincides with the axis of rotation for at least partially
(Continued)

supplying the phase shifter with a pressurizing medium. The duct may extend at least into the bearing portion.

9 Claims, 2 Drawing Sheets

(52) U.S. Cl.
CPC ..... *F01L 2001/0473* (2013.01); *F01L 2001/0476* (2013.01); *F01L 2001/34423* (2013.01)

(56) References Cited

U.S. PATENT DOCUMENTS

| | | | | |
|---|---|---|---|---|
| 7,841,311 | B2 * | 11/2010 | Hutcheson | F01L 1/047 123/90.15 |
| 8,201,528 | B2 * | 6/2012 | Knecht | F01L 1/022 123/90.17 |
| 2002/0020377 | A1 | 2/2002 | Daut | |
| 2006/0185471 | A1 * | 8/2006 | Lawrence | F01L 1/047 74/595 |
| 2011/0162604 | A1 * | 7/2011 | Wigsten | F01L 1/344 123/90.17 |
| 2012/0031358 | A1 * | 2/2012 | Knecht | F01L 1/3442 123/90.15 |
| 2012/0067310 | A1 * | 3/2012 | Methley | F01L 1/047 123/90.15 |
| 2013/0247855 | A1 * | 9/2013 | Adachi | F01L 1/3442 123/90.15 |
| 2015/0090208 | A1 | 4/2015 | Dietel | |
| 2015/0152750 | A1 | 6/2015 | Dietel | |
| 2017/0254232 | A1 * | 9/2017 | Stays | F01L 1/047 |

FOREIGN PATENT DOCUMENTS

| | | | |
|---|---|---|---|
| CN | 104411924 | A | 3/2015 |
| DE | 0 717 171 | A | 6/1996 |
| DE | 19757504 | A | 7/1999 |
| DE | 102006013829 | A | 9/2007 |
| DE | 102006028611 | A | 12/2007 |
| DE | 102008032412 | A | 1/2010 |
| DE | 102011012918 | A | 12/2011 |
| DE | 102012214762 | A | 2/2014 |
| DE | 102012022800 | A | 5/2014 |
| DE | 102013106746 | A | 12/2014 |
| EP | 2527607 | A | 11/2012 |
| WO | 2008028902 | A | 3/2008 |
| WO | 2012171672 | A | 12/2012 |
| WO | 2013037515 | A | 3/2013 |

* cited by examiner

ADJUSTABLE CAMSHAFT HAVING A PHASE ACTUATOR

CROSS REFERENCE TO RELATED APPLICATIONS

This application is a U.S. National Stage Entry of International Patent Application Ser. No. PCT/EP2016/068160, filed Jul. 29, 2016, which claims priority to German Patent Application No. DE 10 2015 113 356.3, filed Aug. 13, 2015, the entire contents of both of which are incorporated herein by reference.

FIELD

The present disclosure generally relates to an adjustable camshafts, including adjustable camshafts for valve trains of internal combustion engines.

BACKGROUND

Adjustable camshafts serve the purpose of a variable valve train of an internal combustion engine, and the phase position of the inner shaft can be adjusted relative to the phase position of the outer shaft by the phase shifter during rotation of the adjustable camshaft. It is also possible to adjust the phase position of the inner shaft and the outer shaft jointly relative to the phase position of a drive wheel, via which drive wheel the camshaft is driven rotationally about the axis of rotation. What are known as dual phase shifters enable, for example, the change of the phase position of the outer shaft and the inner shaft jointly and adjustment of the phase position of the inner shaft relative to the outer shaft is simultaneously possible.

Phase shifters are generally operated by a pressurizing medium, in particular an oil, in that pressure chambers formed between a rotor and a stator of the phase shifter are alternately acted upon fluidically. In order to enable the supply of pressurizing medium to the phase shifter which rotates with the camshaft, supply with the pressurizing medium is generally carried out via a bearing portion on the outer shaft of the camshaft, via which bearing portion the camshaft is mounted in a bearing bridge. The bearing portion generally forms the outermost bearing portion at the end of the camshaft so that the outer shaft and in particular the inner shaft terminate with the bearing portion in their longitudinal direction along the axis of rotation and wherein the phase shifter adjoins the end in the direction of the axis of rotation. The rotor is generally fastened at the end of the inner shaft and the stator of the phase shifter is generally fastened at the end of the outer shaft. Particularly in the case of dual phase shifters, the problem arises that, for example, four or more ducts are necessary in order to load the individual chambers between rotor and stator of the phase shifter with pressurizing medium. If the phase shifter, in particular the rotor, is fastened with a central screw on the inner shaft, particular difficulties arise when accommodating the ducts in the inner shaft and/or the outer shaft as a result of the reduced installation space.

For example, DE 10 2006 028 611 A1 shows an adjustable camshaft with a phase shifter which is screwed at the end side on the inner shaft with a central screw. The outer shaft is received rotatably in a bearing ring, wherein the bearing ring is formed to co-rotate with the outer shaft. The bearing ring is received in an abutment which is formed by the bearing bridge, for example, of the camshaft module or the like and does not co-rotate. Only two oil ducts are represented which are guided on the actuating elements of the phase shifter and which must run via the end-side bearing portion of the camshaft. Further oil ducts are guided via a bearing portion and run centrally through the inner shaft and through a gap between the inner shaft and the outer shaft. It is, however, desirable here to limit the fluid supply of the phase shifter to the end-side bearing portion which is located close to the phase shifter on the camshaft.

A further adjustable camshaft is known from DE 10 2006 013 829 A1, and the inner shaft of the camshaft comprises a threaded bore into which a central screw can be screwed in order to fasten the phase shifter on the camshaft. The accommodation of the oil ducts must consequently be provided on the radial region between the threaded bore and the receiver of the fastening flange which sits on the end side on the outer shaft. The arrangement of a dual phase shifter is, for example, already not readily possible as a result of the restricted space conditions for accommodation of the oil ducts.

DETAILED DESCRIPTION

Figure 1:
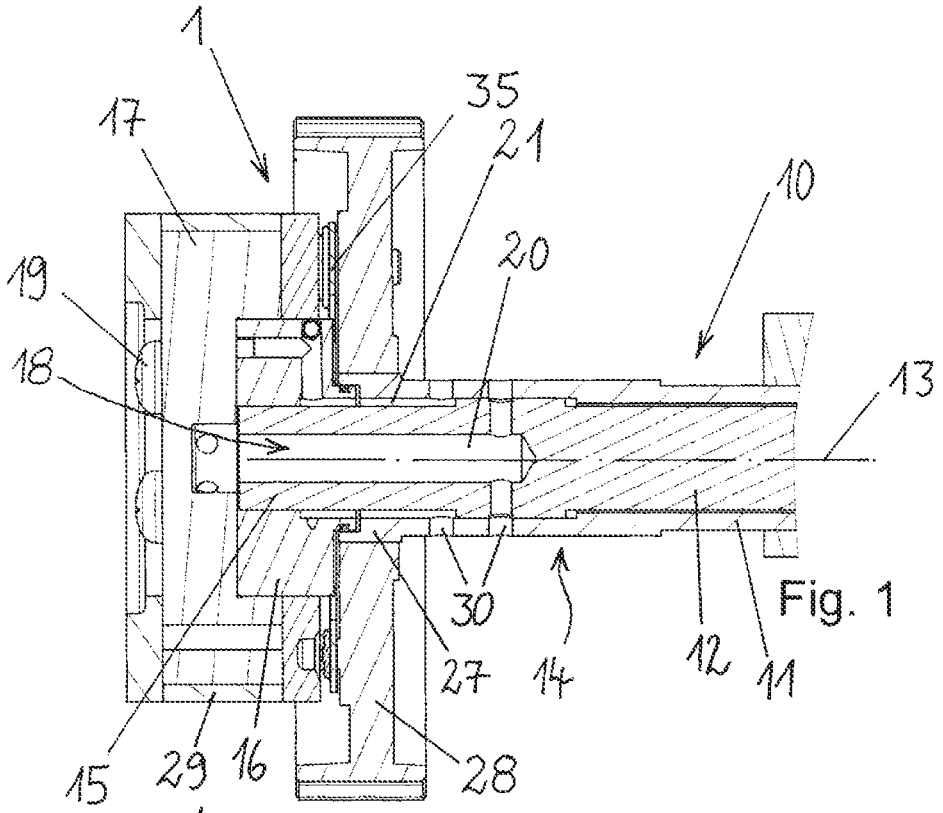
FIG. 1 is a cross-sectional view of an example adjustable camshaft with a phase shifter, wherein an oil duct is formed by a central duct in an inner shaft and a further oil duct is formed by a radial gap between the inner shaft and an outer shaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to adjustable camshafts for valve trains of internal combustion engines. In some examples, an adjustable camshaft may comprise an outer shaft and an inner shaft that is rotatable in the outer shaft, as well as a phase shifter, with which the outer shaft and/or the inner shaft are/is adjustable in a phase position formed around an axis of rotation. Further, the camshaft may comprise a bearing portion for bearing the camshaft, via which the phase shifter can be supplied with a pressurizing medium.

One example object of the present disclosure generally concerns the further development of an adjustable camshaft with an improved arrangement of a phase shifter at an end of the camshaft. Another example object of the present disclosure is to improve the supply of the phase shifter with pressurizing medium via a bearing portion for bearing of the camshaft. In some cases, an enlarged installation space may be created to improve a guidance of pressurizing medium between the bearing portion and the phase shifter.

The invention follows on from the technical teaching that the inner shaft comprises an end on which a screw flange is arranged and wherein a rotor of the phase shifter is connected to the screw flange, and wherein the free end of the inner shaft comprises a duct which coincides with the axis of rotation for at least partial supply of the phase shifter with a pressurizing medium, which duct extends at least into the bearing portion.

The core of the invention is the reconfiguration of the connection of the phase shifter to the adjustable camshaft which is further developed in that a screw which lies in the axis of rotation at the end of the inner shaft can be omitted in order to arrange the phase shifter on the camshaft. Within the present meaning, the central screw is a screw which is screwed into the end of the inner shaft, and the screw is located concentrically to the axis of rotation. If this screw is omitted as a result of a further development according to the invention of the adjustable camshaft with the features of the present invention, a significantly enlarged installation space is produced for the configuration of the ducts in order to produce a pressurizing medium connection between the bearing portion and the phase shifter. Here, the invention provides a central duct which coincides with the axis of rotation and which opens out at the end of the inner shaft to the outside or into the phase shifter so that a phase shifter, which is arranged at the end of the camshaft, can at least also be supplied with a pressurizing medium via the central duct.

The arrangement according to the invention of the screw flange at the end of the inner shaft can be embodied in various ways, wherein the end of the inner shaft does not necessarily have to terminate geometrically with the connection flange, and within the meaning of the invention the end of the inner shaft only relates generally to the region of the inner shaft which adjoins the bearing portion in the direction of the axis of rotation.

For example, the connection of the rotor to the connection flange comprises screw elements, wherein the screw elements are arranged spaced apart from the axis of rotation. In principle, a single screw element can be sufficient in order to connect the rotor of the phase shifter to the screw flange, advantageously, however, several screw elements distributed, for example, evenly on the circumference are provided which are arranged on a partial circle formed around the axis of rotation. The screw elements extend with their longitudinal axis, for example, spaced parallel to the axis of rotation and can be screwed in from the outside of the phase shifter, in particular the rotor, for which purpose the screw flange has, for example, threaded bores.

In the sense of an advantageous exemplary embodiment, the screw flange sits on the end of the inner shaft so that the end extends centrally into the screw flange. For example, the screw flange is placed on the end of the inner shaft by a shrink fit or by a press fit, it is also conceivable that the screw flange is connected in a materially engaged manner, for example, by a welding process, a soldering process or an adhesion process, to the end of the inner shaft. It is particularly advantageous if the screw flange sits centered on the end of the inner shaft with the required precision so that the rotor of the phase shifter can in turn be centered via the screw flange. It is furthermore possible that the screw flange is formed in one piece with the inner shaft so that a connection arrangement between the screw flange and the inner shaft is advantageously omitted.

A particular advantage is achieved if at least in sections an annular gap is formed between the outer shaft and the inner shaft. As a result of this, it is achieved that the central duct forms a first oil duct and the annular gap forms a second oil duct for supplying the phase shifter. The central duct is particularly easy to produce and can to a certain extent replace the threaded bore into which the central screw can be screwed in a manner known per se. As a result of the possibility according to the invention of removing the central screw, the central duct can form the first oil duct, and the annular gap between the inner shaft and the outer shaft forms a second oil duct. The annular gap and the central duct can be supplied by assigned radial ducts in the inner shaft and/or the outer shaft. The radial ducts open out into the running surface of the bearing portion for bearing the camshaft. According to one advantageous further development of the camshaft according to the invention, at least one oil-guidance sleeve is incorporated in the duct while forming an annular gap between the outer surface of the oil-guidance sleeve and the inner surface of the duct, wherein the oil-guidance sleeve forms a first oil duct on the inside and a second oil duct with the annular gap. As a result of this, the advantage is achieved that two oil guides which are separate from one another between the bearing portion and the phase shifter are already formed with a single central duct in the inner shaft, and it is only necessary in an easy manner to incorporate the oil-guidance sleeve into the duct, for example, by pressing in, gluing in or the like. The oil-guidance sleeve is formed, for example, as a thin-walled sheet metal component and can be braced in a self-retaining manner in the duct while forming corresponding tolerances.

A corresponding further development of the pressurizing medium supply of the phase shifter provides that a first oil-guidance sleeve and at least one second oil-guidance sleeve are incorporated in the duct, wherein the oil-guidance sleeves are arranged lying in one another and in particular concentrically to the axis of rotation. In the context of the invention, it is also possible to incorporate more than two oil-guidance sleeves in the duct in order to generate pressurizing medium guides which are separated from one another between the bearing portion and the phase shifter. In particular, it is also possible, in order to supply the phase shifter with pressurizing medium, to include a further bearing portion of the camshaft on which one, in particular two oil ducts are guided.

Further advantageously, the oil-guidance sleeves comprise different lengths and thus extend with different depths into the duct so that the oil ducts formed within and/or between and/or on the outside of the oil-guidance sleeves are fluidically connected to radial ducts, which are separated from one another, in the outer shaft and/or inner shaft. As a result of corresponding graduations in the duct which are formed, for example, from duct portions with different diameters, the individual oil-guidance sleeves should advantageously be connected to one another so that oil guides which are separated from one another between the sleeves are achieved.

It is also possible that at least one of the oil ducts is formed in sections in the screw flange, i.e. continues into it. It is, for example, possible that an oil duct, which is formed by an annular gap between the outside of the inner shaft and the inside of the outer shaft, communicates fluidically with an oil duct, continues into the screw flange. It is also of course possible to form a radial duct in the region on the end of the inner shaft in which the screw flange sits. As a result, the screw flange can also be included in the pressurizing medium guide between the bearing portion and the phase shifter.

There are several possibilities for centering the rotors of the phase shifter in relation to the axis of rotation. It is, for example, possible to center the rotor by means of the screw flange about the axis of rotation or it is possible that a flexible element is arranged between the rotor of the phase shifter and the screw flange, via which flexible element a torque can be transmitted while compensating for positional errors, wherein the rotor itself is centered in the stator of the phase shifter. Flexible elements are known as flex discs or the like, and it is also possible to provide a flexible material, for example, a rubber-elastic material which forms a connection between the rotor and the screw flange. Precise centering of the rotor about the axis of rotation is carried out in that it is guided in the stator of the phase shifter. As a result of the arrangement of a flexible element, the rotor is thus not overdetermined in its guide.

According to a further variant of the adjustable camshaft, the outer shaft comprises an end on which a drive wheel is arranged and wherein a stator of the phase shifter is connected at least indirectly to the drive wheel. It is particularly advantageous if the connection of the stator to the drive wheel comprises a flexible element, in particular a flex disc. At least one part of the phase shifter, i.e. the rotor or the stator, should comprise a rigid, centered arrangement on the inner shaft or on the outer shaft so that the at least one other part of the phase shifter is guided on the centered part.

FIGS. 1 to 4 show in each case exemplary embodiments of an adjustable camshaft 10 which is represented at one end side and comprises an outer shaft 11 and an inner shaft 12. Inner shaft 12 is rotatable with respect to outer shaft 11, wherein a phase shifter 1 is arranged at the end side on camshaft 10 for generation of the rotational movement. Phase shifter 1 comprises a stator 29 in which a rotor 17 is received. Rotor 17 is rotatable in stator 29 about axis of rotation 13 of camshaft 10. Rotor 17 is connected to inner shaft 12, and stator 29 is connected via a drive wheel 28 to outer shaft 11.

A screw flange 16 is fitted on end 15 of inner shaft 12, and rotor 17 of phase shifter 1 is screwed with screw elements 19 on screw flange 16. Stator 29 is guided by means of rotor 17 about axis of rotation 13, and the connection of stator 29 to drive wheel 28 comprises a flex disc 35. Flex disc 35 forms a flexible element between stator 29 and drive wheel 28, wherein torques can be transmitted via flex disc 35.

A duct 18 is incorporated in the region of end 15 of inner shaft 12, which duct 18 freely terminates on the outside with the end side of inner shaft 12. Duct 18 extends into a bearing portion 14 of camshaft 10 into inner shaft 12 so that several possibilities arise for pressurizing medium guidance between bearing portion 14 and phase shifter 1, as is represented in detail below with the respective exemplary embodiments of the figures.

FIG. 1 shows a first exemplary embodiment of camshaft 10 with a phase shifter 1 arranged on the end side, wherein duct 18, which coincides in its direction of extent with axis of rotation 13 of camshaft 10, forms a first oil duct 20. In one portion above duct 18, outer shaft 11 comprises toward inner shaft 12 a circumferential radial gap by which a second oil duct 21 is formed. First oil duct 18 runs out on the inside in inner shaft 12 in radial ducts 30. Second oil duct 21, which is formed by the radial gap, also runs out in radial ducts 30 and opens on the outside into screw flange 16 and is continued therein.

Figure 2:
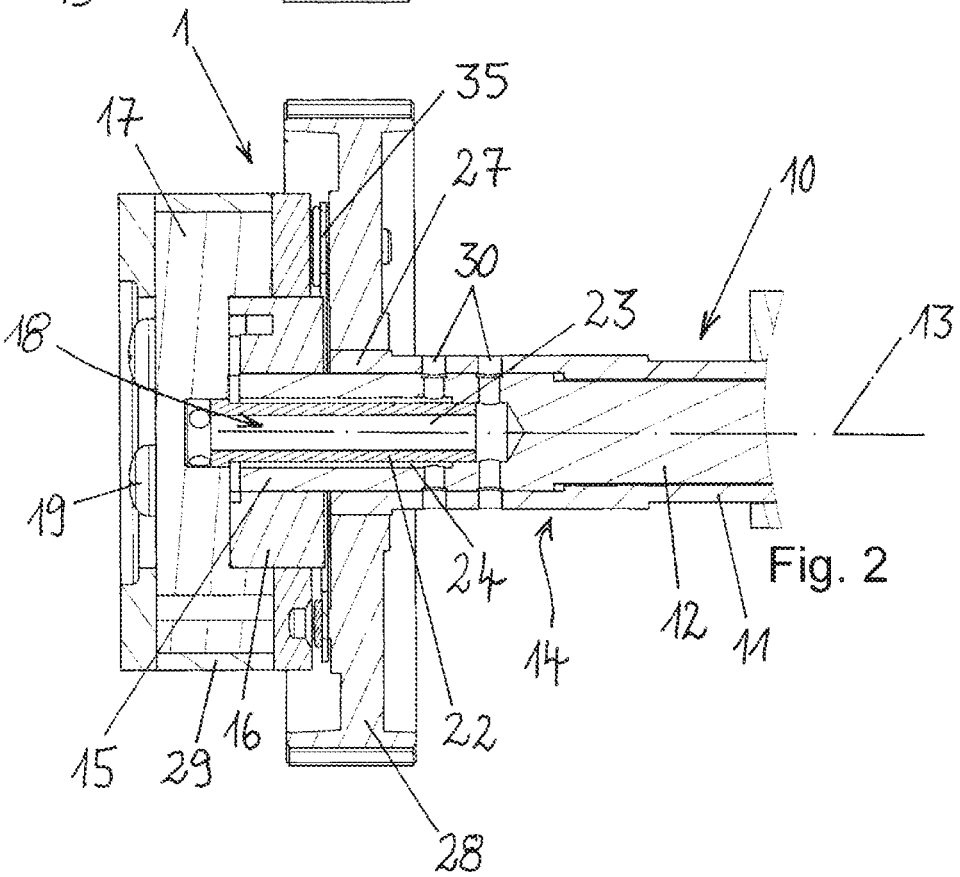
FIG. 2 is a cross-sectional view of an example adjustable camshaft with a phase shifter, wherein an oil-guidance sleeve is incorporated in a duct of an inner shaft.

FIG. 2 shows an exemplary embodiment with a duct 18 in inner shaft 12 of camshaft 10 into which an oil-guidance sleeve 22 is incorporated. Oil-guidance sleeve 22 forms, on the inside, a first oil duct 23, and with the outside of oil-guidance sleeve 22 this forms with the inside of duct 18 in inner shaft 12 an annular gap by which a second oil duct 24 is formed. Respective oil ducts 23 and 24 open out in the region of bearing portion 14 for bearing of camshaft 10 into assigned radial ducts 30. The exemplary embodiment thus highlights the possibility of already forming two oil ducts 23 and 24 running separately from one another by simple incorporation of an oil-guidance sleeve 22 in a central duct 18 in end 15 of inner shaft 12 in order to actuate phase shifter 1.

Figure 3:
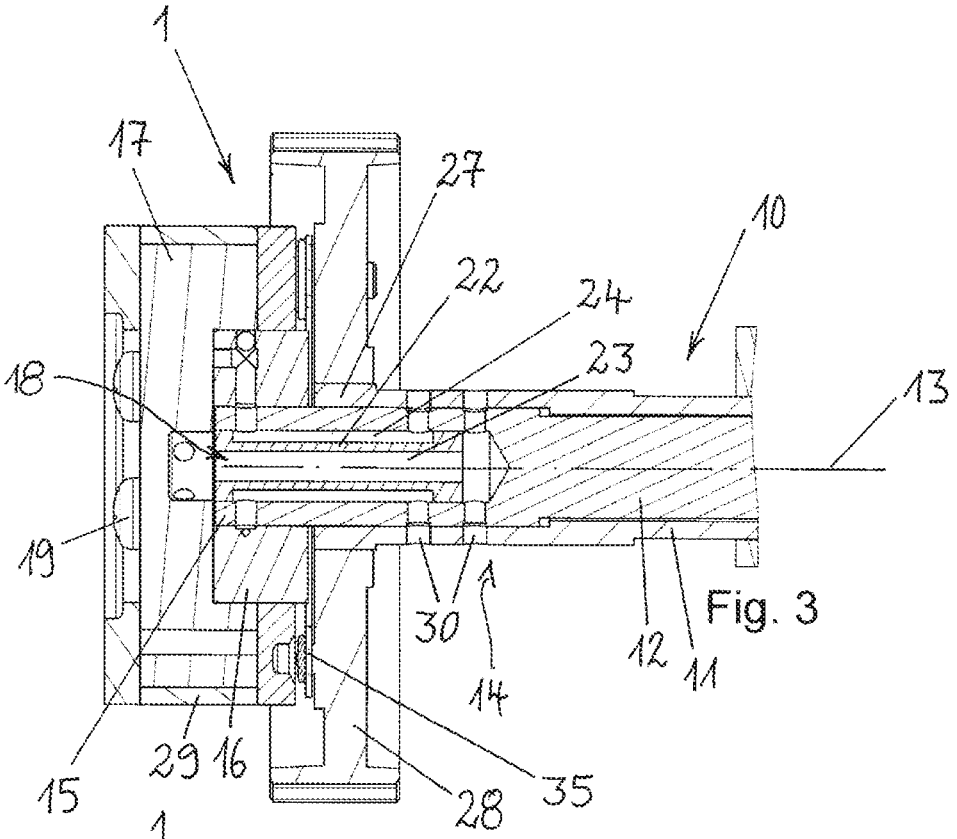
FIG. 3 is a cross-sectional view of another example adjustable camshaft with a phase shifter, wherein an oil-guidance sleeve is incorporated into a central duct.

FIG. 3 shows an exemplary embodiment with a modified configuration of an oil-guidance sleeve 22 which is incorporated in duct 18 in inner shaft 12. The configuration of oil-guidance sleeve 22 comprises end-side collars which seal off against the inside of duct 18 in inner shaft 12. As a result, there are also formed in a simple manner oil ducts 23 and 24 which are separated from one another and which communicate fluidically with respective radial ducts 30 which open out into bearing portion 14.

Figure 4:
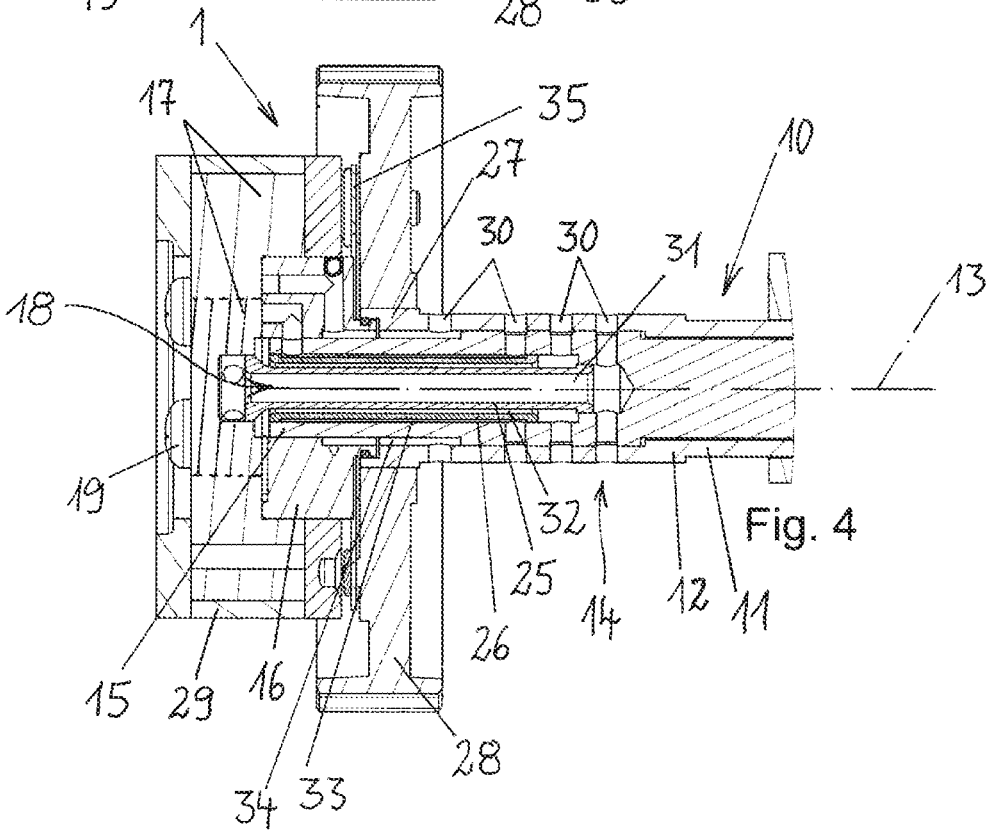
FIG. 4 is a cross-sectional view of still another example adjustable camshaft with a phase shifter, wherein two oil-guidance sleeves are incorporated lying concentrically in one another in a duct in an inner shaft.

Finally, FIG. 4 shows an exemplary embodiment of an adjustable camshaft 10 with a phase shifter 1, wherein phase shifter 1 is formed, for example, as a dual phase shifter, as shown schematically by a, for example, two-part rotor 17. For actuation of phase shifter 1, the exemplary embodiment comprises two oil-guidance sleeves 25 and 26 arranged concentrically to one another, and, while forming an annular gap, oil-guidance sleeve 25 is incorporated lying on the inside in oil-guidance sleeve 26. A first oil duct 31 is thus produced on the inside in inner oil-guidance sleeve 25, a second oil duct 32 is produced by the inner gap between inner oil-guidance sleeve 25 and outer oil-guidance sleeve 26, a further oil duct 33 is produced by a radial gap on the outside of outer oil-guidance sleeve 26 towards the inside of duct 18 and finally a fourth oil duct 33 is produced in the form of an annular gap between the inside of outer shaft 11 and the outside of inner shaft 12. Oil ducts 31, 32, 33 and 34 open out into respective radial ducts 30 which are located in the region of bearing portion 14. Oil ducts 33 and 34 open out into respective projections within screw flange 16 so that it is also included in the oil guide.

The invention is not restricted in terms of its embodiment to the above-mentioned exemplary embodiments. On the contrary, a plurality of variants are conceivable which also make use of the illustrated solution in the case of embodiments of a fundamentally different type. All of the features and/or advantages which are apparent from the claims, the description or the drawings including constructive details or spatial arrangements can be vital to the invention both alone and in a wide variety of combinations.

LIST OF REFERENCE NUMBERS

1 Phase shifter
10 Camshaft
11 Outer shaft
12 Inner shaft
13 Axis of rotation
14 Bearing portion
15 End of the inner shaft
16 Screw flange

17 Rotor
18 Duct
19 Screw element
20 Oil duct
21 Oil duct
22 Oil-guidance sleeve
23 Oil duct
24 Oil duct
25 Oil-guidance sleeve
26 Oil-guidance sleeve
27 End of the outer shaft
28 Drive wheel
29 Stator
30 Radial duct
31 Oil duct
32 Oil duct
33 Oil duct
34 Oil duct
35 Flex disc

What is claimed is:

1. An adjustable camshaft for a valve train of an internal combustion engine, the adjustable camshaft comprising:

an outer shaft;

an inner shaft that extends at least in sections within the outer shaft, wherein the inner shaft is configured to rotate relative to the outer shaft, the inner shaft having a free end that comprises a duct that coincides with an axis of rotation;

a phase shifter by which at least one of the outer shaft or the inner shaft is configured to adjust in a phase position formed around the axis of rotation, the phase shifter comprising a rotor;

a bearing portion for bearing the adjustable camshaft, via which the phase shifter is supplied with a pressurizing medium; and a screw flange disposed on the free end of the inner shaft, wherein the rotor of the phase shifter is connected to the screw flange via a screw element that is spaced apart from the axis of rotation, wherein the duct extends at least partially into the bearing portion and at least partially supplies the phase shifter with the pressurizing medium, wherein an annular gap is formed at least in sections between the outer shaft and the inner shaft, wherein the duct is a central duct that forms a first oil duct, wherein the annular gap forms a second oil duct that supplies the phase shifter.

2. The adjustable camshaft of claim 1 wherein the screw flange sits on the free end of the inner shaft such that the free end extends centrally into the screw flange.

3. The adjustable camshaft of claim 1 wherein at least one of the first oil duct or the second oil duct is formed in sections in the screw flange.

4. The adjustable camshaft of claim 1 further comprising an oil-guidance sleeve that is disposed in the duct, wherein an inside of the oil-guidance sleeve forms a first oil duct and an annular gap between an outer surface of the oil-guidance sleeve and an inner surface of the duct forms a second oil duct.

5. The adjustable camshaft of claim 4 wherein at least one of the first oil duct or the second oil duct is formed in sections in the screw flange.

6. The adjustable camshaft of claim 1 further comprising a first oil-guidance sleeve and a second oil-guidance sleeve disposed in the duct, wherein the first oil-guidance sleeve is disposed within the second oil-guidance sleeve and is concentric to the axis of rotation.

7. The adjustable camshaft of claim 6 wherein the first and second oil-guidance sleeves have different lengths and protrude with different depths into the duct such that oil ducts formed within, between, and/or outside the first and second oil-guidance sleeves are in fluid communication with radial ducts in at least one of the outer shaft or the inner shaft, wherein the radial ducts are separated from one another.

8. The adjustable camshaft of claim 7 wherein at least one of the oil ducts is formed in sections in the screw flange.

9. The adjustable camshaft of claim 1 wherein the outer shaft comprises an end on which a drive wheel is disposed, wherein a stator of the phase shifter is connected to the drive wheel.

* * * * *